US006131206A

United States Patent [19]

Vayda

[11] Patent Number: 6,131,206

[45] Date of Patent: Oct. 17, 2000

[54] GARTER BELT FOR HOCKEY PLAYER

[76] Inventor: Terence E. Vayda, 5006 28th Ct., East Bradenton, Fla. 34203

[21] Appl. No.: 09/149,304

[22] Filed: Apr. 8, 1998

Related U.S. Application Data

[63] Continuation of application No. 08/529,316, Sep. 18, 1995, abandoned, and a continuation of application No. 08/845, 502, Apr. 24, 1997, abandoned.

[51] Int. Cl.[7] ..... A41F 9/00

[52] U.S. Cl. ..... 2/315; 2/312

[58] Field of Search ..... 2/312, 315, 321, 2/322, 335, 311; 602/67–69, 70–73; 24/72.5, 442–447, DIG. 29

[56] References Cited

U.S. PATENT DOCUMENTS 3,501,774 3/1970 Norman ..... 2/321
3,932,897 1/1976 Young ..... 2/306
5,008,987 4/1991 Armour, II ..... 24/442

*Primary Examiner*—Gloria M. Hale
*Attorney, Agent, or Firm*—Charles J. Prescott

[57] ABSTRACT

A garter belt for supporting heavy stockings which cover protective leg gear worn by a hockey player. The garter belt includes a preferably elastic elongated waist engaging belt and a plurality of spaced apart garters each connected at an upper end thereof to, and downwardly depend from, the waist belt. Each lower end of each garter includes a first strip of fastener material formed of the hooked portion of two part VELCRO hook and loop fastener. A second strip of hooked fastener material is connected at its upper end to a mid portion of the garter and positioned to face and be generally coextensive and aligned with the first strip. The first and second strips straddle the stocking opening and are separable for releasible engagement against both inside and outside stocking surfaces just below the stocking opening. At least two garter strips at the front and back of each leg are preferred.

3 Claims, 1 Drawing Sheet

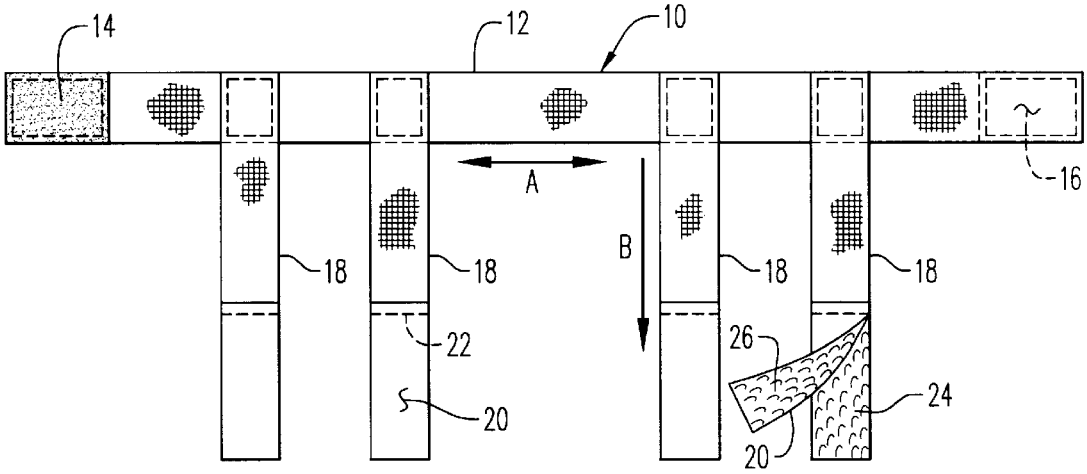
FIG. 1
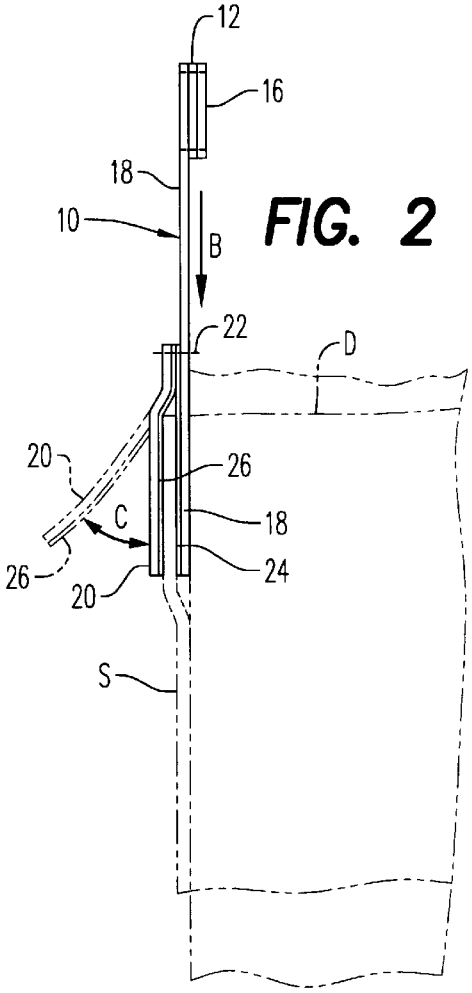
FIG. 2
FIG. 3
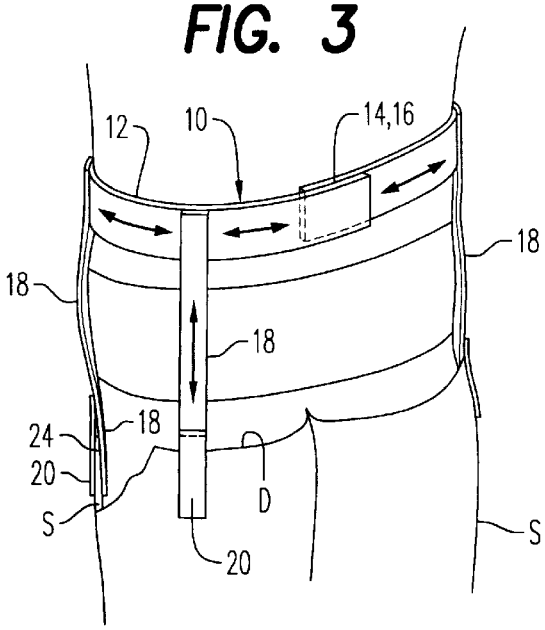

GARTER BELT FOR HOCKEY PLAYER

This is a continuation application of Ser. No. 08/529,316 filed Sep. 18, 1995 now abandoned and Ser. No. 08/845,502 filed Apr. 24, 1997 now abandoned.

BACKGROUND OF THE INVENTION

1. Scope of Invention

This invention relates generally to garter belts, and more particularly to an improved garter belt for use by hockey players to support heavy stockings covering protective leg gear.

2. Prior Art

The use of garter belts by women to support nylon stockings and the like is well known. Typically, these garter belts for women include downwardly extending garters having well-known stocking-engaging members disposed at the lower end thereof such as shown in U.S. Pat. No. 3,932,897 invented by Young. The Young patent is more specifically directed to a hockey garter belt having such stocking engaging members.

Applicant is also aware of U.S. Pat. Nos. 3,880,160 and 4,285,069, both of which are issued to Hall. These patents generally are directed to garter belts also having conventional stocking connecting member disposed at the lower end of each garter.

The present invention is directed to a uniquely configured garter belt having preferably elastic garters downwardly disposed from a waist encircling belt, each lower end portion of each garter including facing first and second strips of fastener material formed by the densely spaced hooked members of two part VELCRO, hook and loop fastener. These first and second strips are separable at the lower ends thereof so as to be positioned astride or straddling each side of the upper openings of each stocking. The hooked hook and loop fastener, VELCRO surfaces releasibly engaged into both inner and outer surfaces of the fabric material of the stockings and act in unison to support the stocking.

BRIEF SUMMARY OF THE INVENTION

This invention is directed to a garter belt for supporting heavy stockings which cover protective leg gear worn by a hockey player. The garter belt includes a preferably elastic elongated waist engaging belt and a plurality of spaced apart garters each connected at an upper end thereof to, and downwardly depend from, the waist belt Each lower end of each garter includes a first strip of fastener material formed of the hooked portion of two-part hook and loop fastener, VELCRO. A second strip of hooked fastener material is connected at its upper end to a mid portion of the garter and positioned to face and be generally coextensive and aligned with the first strip. The first and second strips straddle the stocking opening and are separable for releasible engagement against both inside and outside stocking surfaces just below the stocking opening. At least two garter strips at the front and back of each leg are preferred.

It is therefore an object of this invention to provide an improved garter belt for use by hockey players in more effectively and reliably supporting the heavy stockings worn to conceal protective leg gear.

It is yet another object of this invention to provide an improved garter belt for hockey players which more effectively releasibly engages with the heavy stockings worn by hockey players without modification or special stocking structure It is still another object of this invention to provide an improved garter belt for hockey players utilizing separable hooked material of hook and loop fastener, VELCRO in facing fashion so as to interengage against both inside and outside surfaces of the upper portions of each stocking for enhanced engagement therebetween.

In accordance with these and other objects which will become apparent hereinafter, the instant invention will now be described with reference to the accompanying drawings.

BRIEF DESCRIPTION OF THE DRAWINGS

FIG. 1 is a front elevation view of the outer or exposed surface of the preferred embodiment of the invention.

FIG. 2 is a right side elevation view of FIG. 1 in relation to a stocking and a leg of a hockey player shown in phantom.

FIG. 3 is a broken perspective view of the invention of FIG. 1 in position during use.

DETAILED DESCRIPTION OF THE INVENTION

Referring now to the drawings, the invention is shown generally at numeral 10 and includes an elastic, elongated waist encircling belt 12 and a plurality of downwardly extending spaced apart garters 18. The waist belt 12 is formed of elastic fabric primarily stretchable in the direction of arrow A. One end portion 14 of waist belt 12 is covered with pile or looped fabric material best known commercially as two-part hook and loop fastener, VELCRO while the opposite end on the opposite surface of waist belt 12 is covered at 16 with the hooked hook and loop fastener, VELCRO material. By this arrangement, the hockey player may stretch a properly sized waist belt 12 around his waist for releasible engagement between pile surface 14 and hook surface 16 as shown in FIG. 3.

The plurality of garters 18 are sewn at their upper end portions thereof in spaced relation to waist belt 12 as in FIG. 1. These garters 18 are spaced so that, when waist belt 12 is stretched and secured in position as shown in FIG. 3, one garter is downwardly disposed along the upper front and rear thigh areas of each leg of the hockey player as shown.

Each of the garters 18 includes a length of hooked hook and loop fastener VELCRO fabric 24 extending downwardly from mid-point transverse stitching 22 to the lower end of the garter 18. A second strip of hooked hook and loop fastener, VELCRO 20 having the hooked surface 26 facing the hooked hook and loop fastener VELCRO surface 24 is connected along stitching 22 only and generally coextensive with the lower portion of garter 18 as shown.

When hooked fabric surfaces 24 and 26 are positioned against one another and not in use, very little, if any, attachment occurs. However, when ready for use, the two surfaces 24 and 26 are easily separable in the direction of arrow C in FIG. 2 so that, after waist belt 12 is stretched and in place around the hockey players waist and the stockings S are also in place, each garter 18 may be stretched downwardly in the direction of arrow B so that hooked fabric 24 is positionable against the inside surface of the stocking below its upper margin D, while the second strip 20 and its hooked hook and loop fastener, VELCRO fabric surface 26 are positionable in opposing fashion on the outer surface of the stocking S as seen in FIG. 2. Thereafter, simply pressing against the second strip 20 fully engages the hooked fabric surfaces 24 and 26 into the fabric of the stocking S.

By this arrangement, each garter 18 engages both inner and outer surfaces in parallel cooperative engagement with the stocking S for supporting the stocking and for enhanced engagement therebetween. No modifications or holes are required with respect to the stocking material and the dual engagement of both inner and outer surfaces of the stocking at least doubles the releasibly attractive engagement strength of the hooked hook and loop fastener VELCRO surfaces with the stocking fabric. Whereas, a single hooked hook and loop fastener VELCRO surface, whether positioned against the inside or the outside surfaces of the stocking would quickly become dislodged, the unexpected unique features of the dual attachment of this invention have been shown to produce unexpectedly secure attachment with virtually no inadvertent or accidental disengagement during active experimental use by hockey players.

Although the preferred embodiment 10 includes both elastic waistband 12 and elastic garters 18, nonetheless the present invention will function equally well with non-elastic members equally well so long as the straddling effect of the hooked hook and loop fastener VELCRO surfaces 24 and 26 are incorporated therein.

In the preferred embodiment, the hooked hook and loop fastener, VELCRO surfaces are preferred. However, of lesser effectiveness, the pile hook and loop fastener VELCRO surfaces in lieu thereof are contemplated within the scope of this invention.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. For a garter belt of the type used by a hockey player to support stockings, said garter belt of the type which includes an elongated waist encircling belt having mating releasibly engagable hook and loop covered end portions which adjustably overlap lengthwise for connection around the hockey player's waist a plurality of elongated garters each connected at one end portion thereof in spaced relation from each said belt end portion and along the length of said belt, another end portion of each garter comprising;

a first strip of fastener material secured thereto, said fastener material formed of densely spaced hook members which releasibly engage with a fabric forming a stocking worn by the hockey player;

a second strip of said fastener material secured at an upper end thereof to, and facing and generally coextensive with said first strip;

said first and second strips opposingly oriented for releasible connection with an inside stocking surface and an outside stocking surface, respectively, of the stocking, said first and second strips of at least two said garters cooperatively acting for supportive engagement with each stocking.

2. In a garter belt for supporting heavy stockings worn to cover protective leg gear used by a hockey player, said garter belt including an elongated waist engaging belt and a plurality of spaced apart garters dependently connected and downwardly extending from said belt, each said garter including means positioned at a lower end thereof for releasible supportive engagement with an upper open end of each stocking, said means for engagement consisting essentially of:

a first strip of fastener material secured to a lower portion of each said garter, said fastener material formed of densely spaced hook members which releasibly engage with a fabric forming each stocking;

a second strip of said fastener material secured at an upper end thereof to, and facing and generally coextensive with said first strip;

said first and second strips opposingly oriented for releasible connection with an inside stocking surface and an outside stocking surface, respectively, of the stocking, said first and second strips of at least two said garters cooperatively acting for supportive engagement with each stocking.

3. A garter belt for supporting stockings worn by a hockey player, consisting essentially of:

an elongated waist encircling belt having mating releasibly engagable hook and loop covered end portions which adjustably overlap lengthwise for connection around a hockey player's waist;

a plurality of elongated garters each connected at one end portion thereof in spaced relation from each said belt end portion and along the length of said belt;

another end portion of each said garter having a first non-elastic strip of fastener material secured thereto, said fastener material formed of densely spaced hook members which releasibly engage with a fabric forming a stocking worn by the hockey player;

a second strip of said fastener material secured only at an upper end thereof to, and facing and generally coextensive with said -fastener material of said first strip whereby said first and second strips are separable from a lower end toward said upper end;

said first and second strips straddling an upper margin of the stocking for releasible connection with an inside stocking surface and an outside stocking surface, respectively, of the stocking whereby said first and second strips of said garters cooperatively act in parallel fashion to supportively engage each upper margin of each stocking.

* * * * *